US005608977A

United States Patent [19]

Burtch et al.

[11] Patent Number: 5,608,977

[45] **Date of Patent: *Mar. 11, 1997**

[54] ERECTABLE PERISCOPING DISPLAY DEVICE

[76] Inventors: Ronald P. Burtch, 4226 Asherton Dr., Charlotte, N.C. 28210; Irving M. Koltz, 175 Bamburgh Cir., Scarborough, Ontario, Canada, M1W 3X8

[ * ] Notice: The term of this patent shall not extend beyond the expiration date of Pat. No. 5,479,732.

[21] Appl. No.: 555,987

[22] Filed: Nov. 15, 1995

Related U.S. Application Data

[63] Continuation-in-part of Ser. No. 263,337, Jun. 21, 1994, Pat. No. 5,479,732.

[51] Int. Cl.[6] ..... G09F 1/06

[52] U.S. Cl. ..... 40/124.15; 40/539; 40/610

[58] Field of Search ..... 40/124.1, 120, 40/155, 539, 610

[56] References Cited

U.S. PATENT DOCUMENTS

| | | | |
|---|---|---|---|
| 2,125,424 | 8/1938 | Cloud | 40/539 |
| 2,142,826 | 1/1939 | Rosello . | |
| 2,311,218 | 2/1943 | Fandrich . | |
| 2,449,911 | 9/1948 | Roth . | |
| 2,472,166 | 6/1949 | Mathewson | 40/124.1 |
| 2,530,950 | 11/1950 | Ebert et al. . | |
| 2,720,046 | 10/1955 | Decker . | |
| 2,920,409 | 1/1960 | Sampson | 40/124.1 X |
| 2,975,905 | 7/1961 | Foland | 40/124.1 X |
| 3,029,051 | 4/1962 | Nichols . | |
| 3,226,863 | 1/1966 | Southard . | |
| 3,763,583 | 10/1973 | Gregg | 40/124.1 |
| 5,259,133 | 11/1993 | Burtch . | |
| 5,287,641 | 2/1994 | Showers . | |
| 5,479,732 | 1/1996 | Burtch et al. | 40/124.1 |

FOREIGN PATENT DOCUMENTS

| | | | |
|---|---|---|---|
| 162551 | 5/1921 | United Kingdom | 40/124.1 |
| 881755 | 11/1961 | United Kingdom . | |

*Primary Examiner*—Peter M. Cuomo
*Assistant Examiner*—James O. Hansen
*Attorney, Agent, or Firm*—Larson and Taylor

[57] ABSTRACT

A display device is provided which comprises a support portion and an integral display portion constructed in such a manner that the portions are relatively movable, through a periscoping action of the display portion, between a planar configuration of the device wherein the display portion is substantially covered by the support portion, and an erected configuration of the device wherein the display portion extends upwardly from a support formed by the support portion. The display portion comprises a display panel including a tongue which, in the erected configuration, extends through a central slot in the display portion and a base including shoulders disposed on opposite sides of the tongue. The support portion includes two pairs of serially arranged panels which, in the planar configuration, lie flat and overlie respective faces of the display panel and which, in said erected configuration, form the support for the display panel. An end panel is secured to the display panel. In one embodiment, the end panel and display panel form a pocket for a planar element such as a credit card and in another embodiment, the display portion includes a retaining band for retaining such an element.

25 Claims, 4 Drawing Sheets

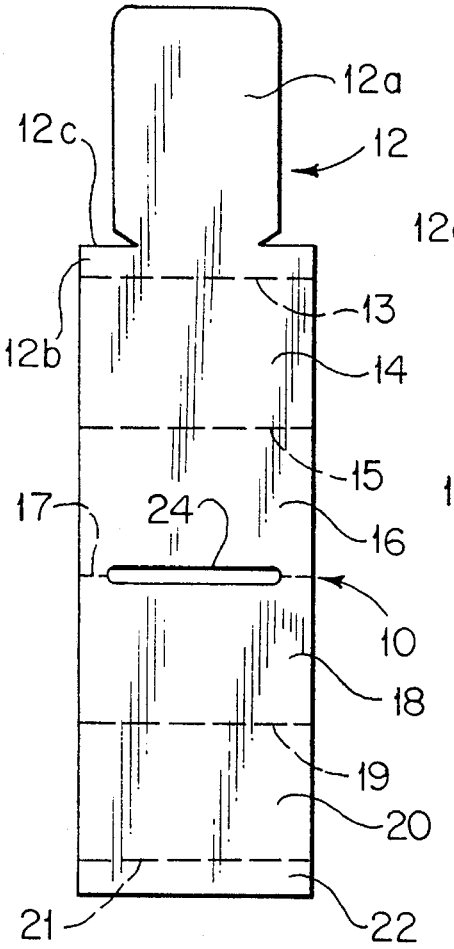
FIG. 1
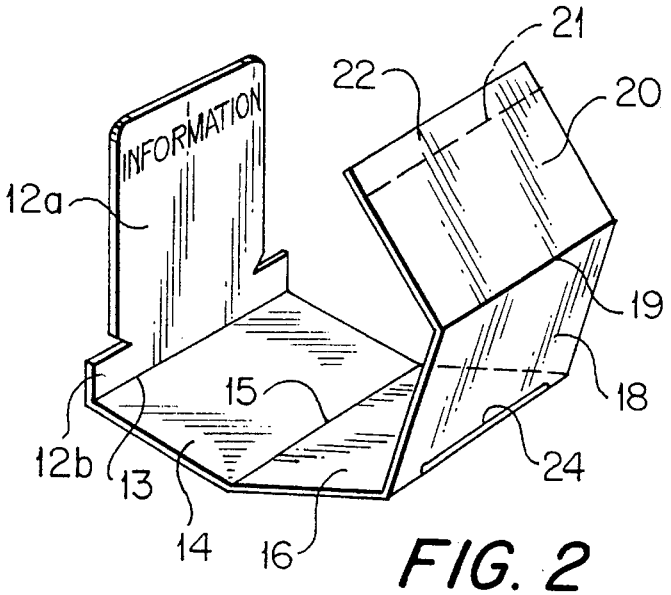
FIG. 2
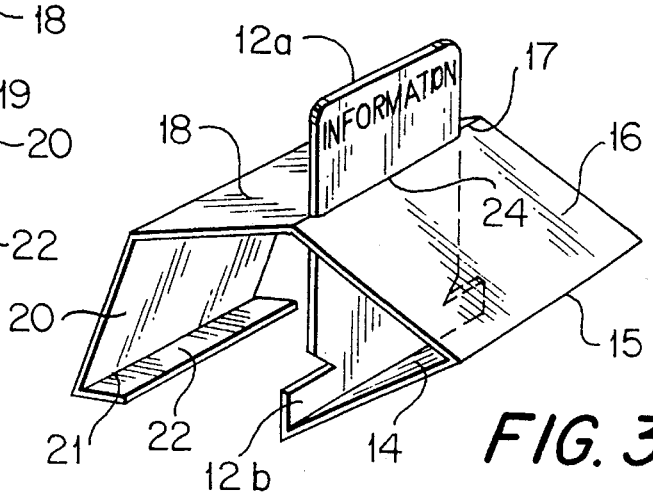
FIG. 3
FIG. 4
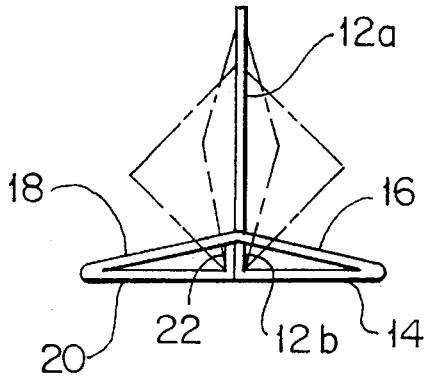
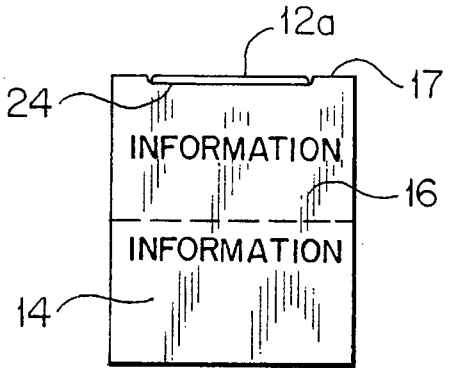
FIG. 5

FIG. 16
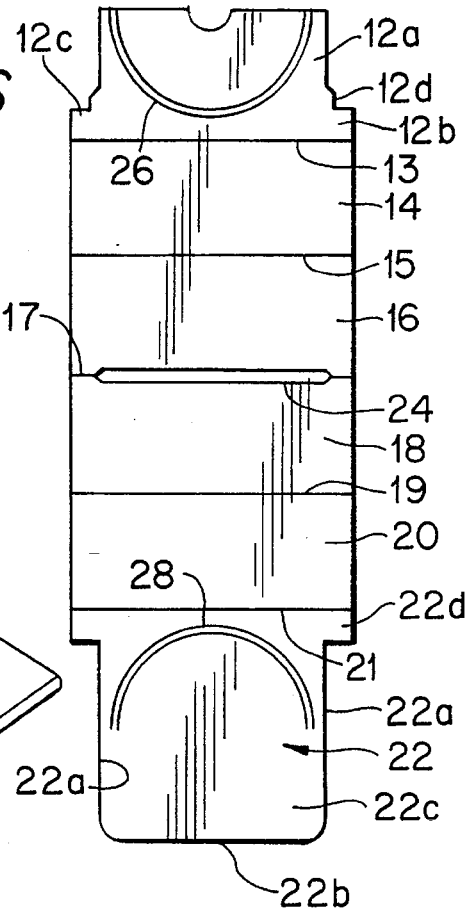
FIG. 15
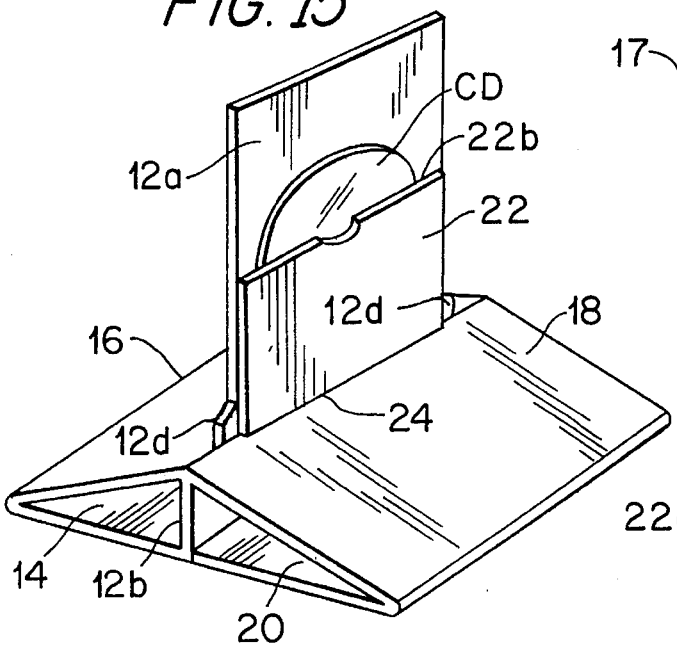
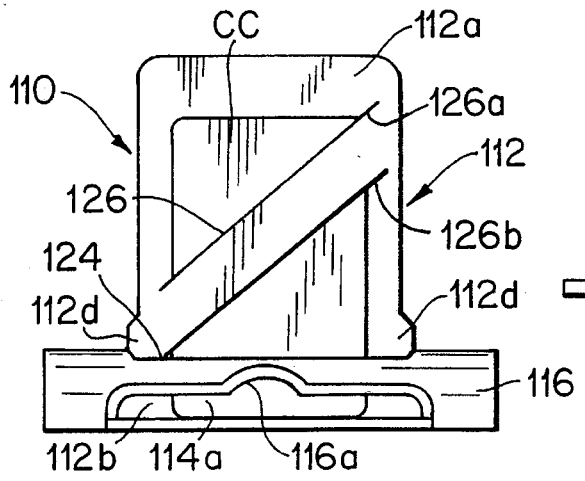
FIG. 17
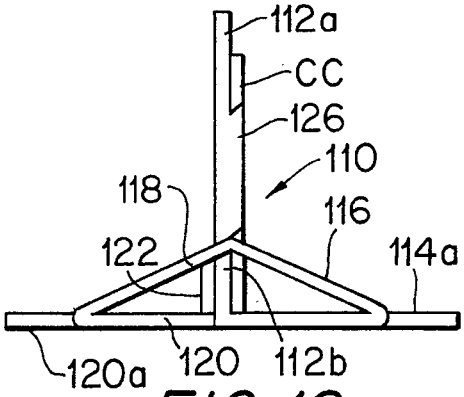
FIG. 18
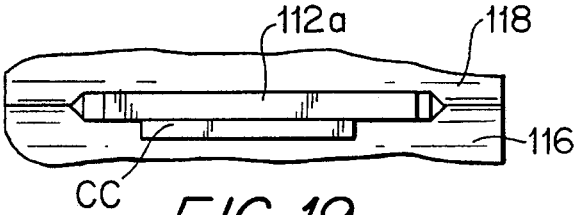
FIG. 19

ERECTABLE PERISCOPING DISPLAY DEVICE

CROSS REFERENCE TO RELATED APPLICATIONS

This application is a continuation-in-part of U.S. application Ser. No. 08/263,337, filed on Jun. 21, 1994, now U.S. Pat. No. 5,479,732.

FIELD OF THE INVENTION

The present invention relates to display devices including novelty items used, e.g., for promotional purposes and/or as items to be collected in sets, and, more particularly, to an erectable display device which provides for a periscoping action of a display portion or panel in erecting of the device from a planar configuration.

BACKGROUND OF THE INVENTION

Although the invention is clearly not limited to such an application, one application thereof is in connection with an erectable baseball card. In an earlier patent, U.S. Pat. No 5,259,133 (Burtch), in which one of the co-inventors here is the patentee, there is described a "pop-up" display device which includes an erectable pop-up display portion that is erectable from a planar configuration, in which the device resembles a baseball card or the like, to a display configuration or state wherein an action figure such as a baseball player "pops up" from the baseball "card" and is displayed. As explained in that patent, baseball cards are very popular in the United States and throughout the world, particularly with younger fans, and many of these fans also collect similar cards involving sports such as football, basketball, hockey and the like. Such sports cards are typically flat, i.e., two dimensional, cards containing a photograph of a particular player together with identifying information on one side and further information, such as the birth date, home town, team or teams played with, and playing records of the player, on the other side. The "pop-up" display device of this earlier patent provides added interest as compared with conventional cards because of the pop-up feature.

As indicated above and explained in more detail below, the present invention generally relates to a display device which provides a periscoping action in the transformation thereof from a flat configuration to an erected, display configuration wherein a display portion or panel is supported by an erectable base. Patents of interest with respect to display structures including related base constructions include the following: U.S. Pat. Nos. 2,142,826 (Rosello); 3,226,863 (Southard); 2,449,911 (Roth); 2,311,218 (Fandrich); 2,530,950 (Ebert et al); 3,092,051 (Nichols); 2,720,046 (Decker) and U.K. Patent No. 881,755 (Hunneman). The U.K. (Hunneman) patent discloses an erectable display device including a display portion that undergoes a periscoping action when the device is erected from a flat configuration to a display configuration. In general, the other patents disclose display structures including a base in the form of an isosceles triangle in end view and including central upright support elements (e.g., the Rosello and Nichols patents), and/or which define a slot or opening (e.g., the Roth, Decker and Fandrich patents), adapted to support an advertising display member, e.g., a display card or the like (or in the case of the Nichols patent, a calendar pad). In the display device of the Ebert et. al. patent, an upright element defines a "poster" while in the Southard patent an easel-type support is provided which includes an extendable and retractable "tab." A further patent of general interest is U.S. Pat. No. 5,287,641 (Showers) which relates to a collectible card device including a sliding insert.

As discussed below, a further aspect of the invention concerns the provision of a display device which, in addition to serving as a display function, also acts as a package or covering for a substantially flat or planar element to be displayed, such as a compact disc. Representative patents relating to such packages include: U.S. Pat. Nos. 5,188,229 (Bernstein); 5,460,265 (Kiolbasa); 4,709,812 (Kosterka); 5,085,318 (Leverick) and 5,101,973 (Martinez).

SUMMARY OF THE INVENTION

In accordance with the invention, a display device is provided which is convertible through a periscoping action between a generally flat or planar configuration wherein the device is in the nature of a card or flat package and can, for example, include the "information" (player photograph, statistics and so on) found on a baseball card, and an erected configuration wherein a display member or panel is supported by a base structure formed by the remainder of the card and presents other "information" or the like which was previously hidden from view.

In accordance with one aspect of the invention, a display device is provided which comprises a support portion and an integral display portion adjoined to the support portion, the display and support portions being relatively movable between a first, planar configuration wherein the display portion is substantially covered by the support portion, and a second, erected configuration wherein the display portion extends upwardly from a base formed by the support portion, the support portion including first and second pairs of serially arranged panels defined by fold lines and formed integrally with the display portion so that in the planar configuration said pairs of panels lie flat and overlie respective faces of the display portion and so that in the erected configuration the pairs of panels are disposed at an angle to form said base for the display portion, adjacent panels of said pairs of panels being joined along a central fold line having a central opening therein through which the display portion periscopes during said relative movement of the display and support portions from said planar configuration to the erected configuration, non-adjacent panels of the pairs of panels lying flat on a supporting surface in the erected configuration of the device, and the device including retaining means for retaining the device in the erected configuration upon movement thereof to the erected configuration from the planar configuration.

Preferably, the display portion comprises a first display panel including a tongue portion and a base portion including shoulders disposed on opposite sides of the tongue portion. In a preferred embodiment, the display portion further includes an end panel joined to one panel of said pairs of panels along a further fold line and secured to the display panel. Advantageously, the end panel is secured to the base portion of the display panel.

The retaining means preferably includes a portion of said opening. Advantageously, the opening comprises a slot and the retaining means includes slits of narrower width than the slot formed at opposite ends of the slot. Preferably, the retaining means includes lateral portions of the display portion which engage in said slits. The lateral portions advantageously comprise oppositely extending, laterally projecting web portions formed between the tongue portion and base portion of the display panel.

In a preferred embodiment, one or more panels of the support portion of the device include wing portions or "wings" which project laterally of the assembled, erected device. This embodiment provides additional interest and appeal over an embodiment not including such wings.

In another implementation which can incorporate either of the embodiments discussed above, i.e., embodiments with and without "wings," the display portion is used to mount one or more planar objects such as a diskette, credit card, compact disc, and the like so that the element is displayed in the erected configuration of the device and is covered and stored, as in a package, in the collapsed configuration. In one embodiment of this implementation, a retainer band is provided in the display portion while in another embodiment, a display panel and an end panel of the display portion are selectively affixed together to form a pocket for the planar element.

Other features and advantages of the invention will be set forth in, or apparent from, the following detailed description of the preferred embodiment of the invention.

BRIEF DESCRIPTION OF THE DRAWINGS

FIG. 1 is a plan view of a blank constructed in accordance with a first, preferred embodiment of the invention;

FIGS. 2 and 3 are perspective views showing two steps in the assembly of the display device of this embodiment from the blank of FIG. 1;

FIG. 4 is an end elevational view showing the assembled device in the erected configuration, with intermediate configurations being shown in dashed lines;

FIG. 5 is a plan view of the assembled device in the flat or planar configuration;

FIG. 15 is a perspective view of a display device in accordance with a still further embodiment of the invention;

FIG. 16 is a plan view of a blank for yet another embodiment of the invention; and FIG. 17, 18 and 19 are a side elevational view, an end elevational view, and a partially broken away top plan view, respectively, of a further embodiment of the invention.

DESCRIPTION OF THE PREFERRED EMBODIMENTS

Figure 6:
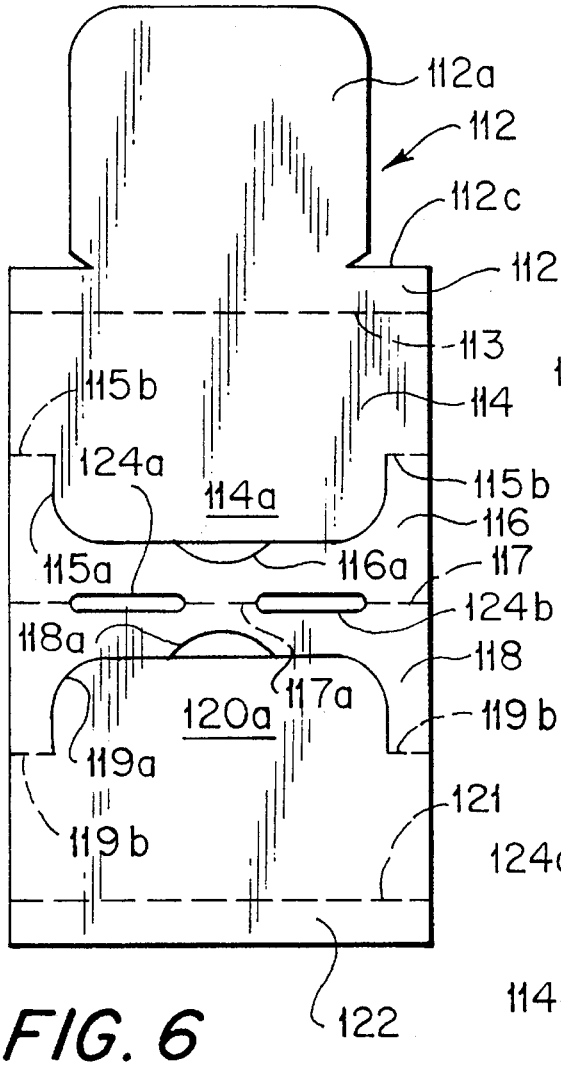
FIG. 6 is a plan view of a blank constructed in accordance with a further preferred embodiment of the invention.

Referring to FIGS. 1 to 5, a first preferred embodiment of the display device of the invention is shown. FIG. 1 illustrates the blank 10 from which the display device is made and, as shown, blank 10 includes a display portion or panel 12 including an elongate tongue portion 12*a*, which is more narrow in width than the remainder of the blank 10, and a base portion 12*b* which extends the full width of the blank 10 so as to form shoulders 12*c* on opposite sides of tongue portion 12*a*. A series of five rectangular panels 14, 16, 18, 20 and 22 are formed or defined by respective fold lines 13, 15, 17, 19 and 21, as illustrated. A slot or elongate opening 24 is formed centrally along fold line 17 between panels 16 and 18 and is a width to permit tongue portion 12*a* to be inserted therethrough.

Referring to FIGS. 2 and 3, two steps in the assembly from blank 10 of the display device of this embodiment are shown. As illustrated, the blank 10 is folded along the various fold lines referred to above and the end opposite to tongue portion 12*a*, i.e., that formed by panel 22, is brought toward and over tongue portion 12*a* so that tongue portion 12*a* can be inserted through slot 24. End panel 22 is then brought into registration with the base portion 12*b* of display panel 12, and adhered thereto, as shown in FIG. 4, such as by gluing.

Referring to FIGS. 4 and 5, the assembled display device shown in the two .operative or end configurations thereof. Although it will be appreciated that the designation of one configuration as the first configuration is arbitrary, in the first or closed configuration shown in FIG. 5, the display device assumes a flat or planar configuration so as to resemble a flat card or the like. In this configuration the display panel 12 including tongue portion 12*a* is substantially completely covered by the remainder of the device and, in particular, the information carrying side or surface of tongue portion 12*a* is covered by panels 14 and 16. As shown, the tip of tongue portion 12*a* extends out of slot 24 above panel 16 and thus enables tongue portion 12*a* to be gripped by the fingers.

Turning now to the second, display configuration, by holding on to the exposed tip of tongue portion 12*a* and pushing panels 14 and 16 and opposed panels 18 and 20 downwardly as indicated in dashed lines in FIG. 4, the panels are brought into the position or configuration shown in solid lines in FIG. 4. In this configuration, adjoining edges of panels 16 and 18 rest at fold line 17 on the base formed by shoulders 12*c* of base portion 12*b* of panel 12 and by the panel 22 secured to base portion 12*b*. This base thus serves as an end stop for the movement of the panels. It will be appreciated that display panel 12 performs what can be termed a periscoping movement up through slot 24 until tongue portion 12*a* is fully exposed. It will be appreciated that in this position, i.e., in the erected configuration of FIG. 4, panels 14, 16 and 18, 20 form a stand or support base for display panel 12.

It will be understood that the names "display" portion and "support" portion are not meant to exclusively define the functions of the two portions 10 and 12 and that, for example, the support portion also serves as a display function. As shown in FIG. 5, the panels 14 and 16 can both contain "information" which is visible, i.e., is displayed, in the planar configuration of the device, and that the "information" displayed by panel 16 is also visible in the erected configuration of FIG. 4. It will also be understood where the device is used, for example, as a giveaway item to promote a product, that this "information" can take the form of a product name, advertising copy, pictures or photographs of the product (or of the product in use) and so on. Of course, the display device can be used in many other ways, including, for example, as an erectable sports card (e.g., a baseball card) wherein a player would be depicted and relevant statistics set out on the card. The tongue portion 12*a* could include an action photograph of a player printed thereon or separately affixed thereto and could be cut out or shaped so as to, e.g., follow the outline of the player as depicted in action.

Referring to FIGS. 6 to 9, a second preferred embodiment of the invention is illustrated. FIG. 6 illustrates the blank used in this embodiment and because the basic overall blank is similar to that of FIG. 1 corresponding elements have been given the same reference numerals preceded by a "1" so that, e.g., the blank is designated 110 and the display panel is designated 112. The chief difference between the two embodiments is that additional precut portions are provided in the blank 110 of FIG. 6. Specifically, the simple fold lines 15 between panels 14 and 16 of the embodiment of FIG. 1 are replaced in FIG. 6 with a central cut line portion 115*a* with fold lines 115*b* on opposite sides thereof. The cut line portion 115*a* forms a shaped projecting tab or wing 114*a* which extends or projects from panel 114 into what would be panel 16 in the embodiment of FIG. 1. Further, a gripping notch or recess 116*a* is provided in panel 116 adjacent the center of tongue 114*a*. Similarly, panel 120 includes a wing portion 120*a* formed by a precut line 119*a* and adjacent panel 118 includes a gripping notch 118*a*, as illustrated.

In addition, in the embodiment of FIG. 6, in place of slot 24 of FIG. 1, two gripping slots 124*a* and 124*b* are formed along fold line 117 and the fold line is cut at a section thereof between slots 124*a* and 124*b* to form a slit denoted 117*a*.

The method of assembly of the display device of the embodiment of FIGS. 6 to 9 is essentially the same as discussed above wherein tongue 112*a* is inserted through the opening provided by slots 124*a* and 124*b* and connecting slit 117*a*, and the end panel 122 is secured, e.g., by an adhesive provided thereon or by gluing, to the base portion 112*b* of panel 112.

Figure 8:
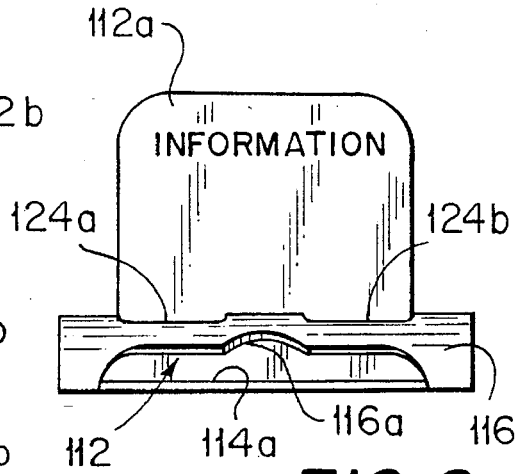
FIG. 8 is a side elevational view of the assembled display device of FIG. 7.
Figure 9:
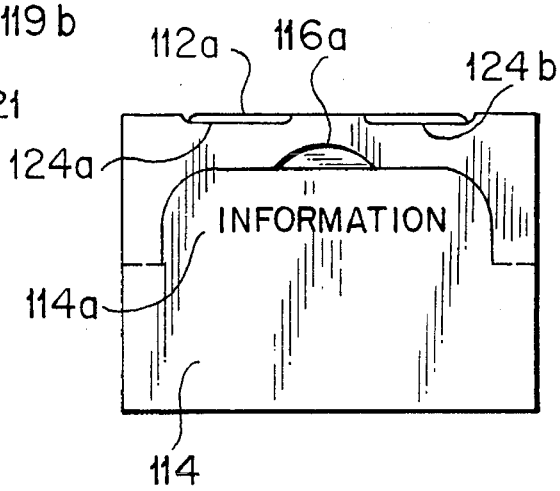
FIG. 9 is a plan view of the device of FIGS. 7 and 8, in the planar configuration thereof.
Figure 7:
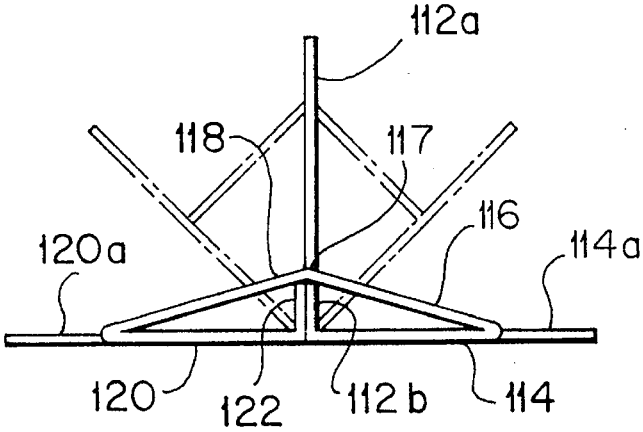
FIG. 7 is an end elevational view of the assembled display device of this embodiment in the erected configuration thereof, with an intermediate configuration shown in dashed lines.
Figure 10:
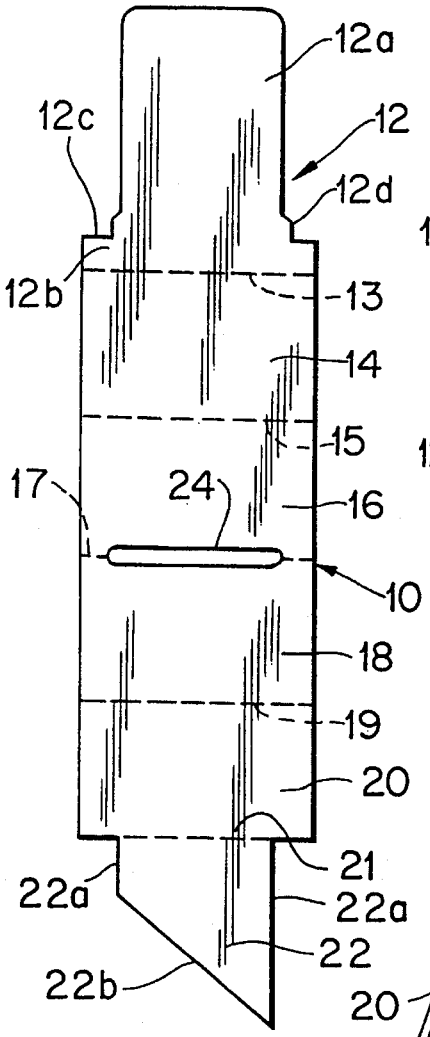
FIG. 10 is a plan view, similar to FIG. 1, of a display device in accordance with a further embodiment of the invention.
Figure 11:
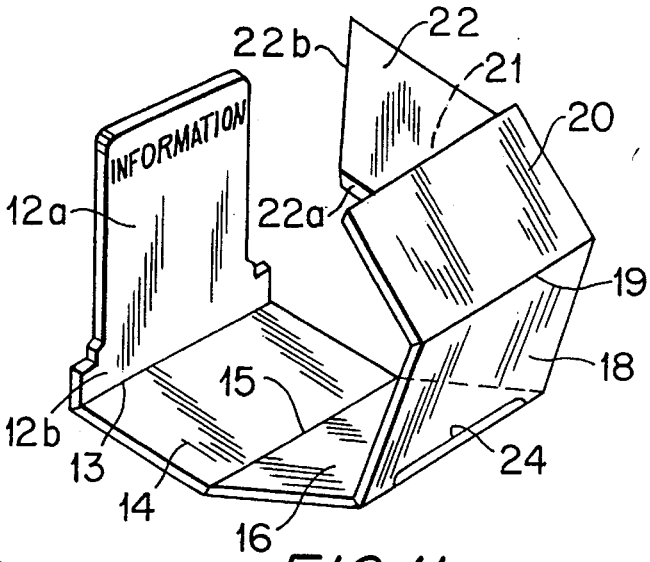
FIGS. 11 and 12 are perspective views showing two steps in the assembly of the display device from the blank of FIG. 10.
Figure 12:
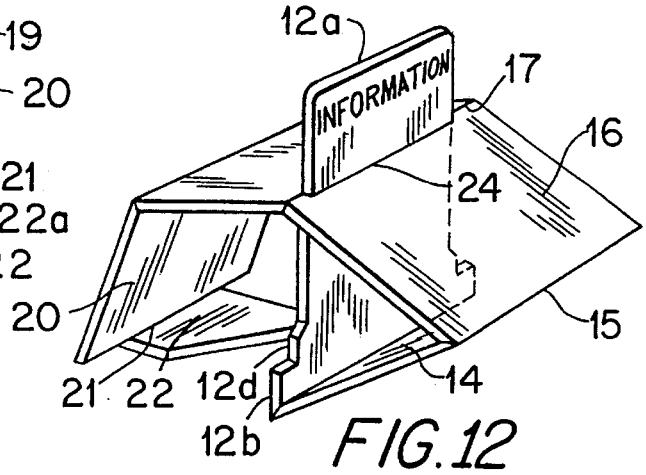
Figure 13:
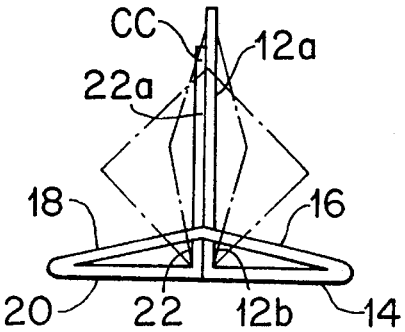
FIG. 13 is an end elevational view of the assembled device of FIGS. 10 to 12 in the erected or display configuration thereof.

The final product is illustrated in its erected configuration in FIGS. 7 and 8 and, as indicated, the salient feature of this embodiment is that tabs or wings 114*a* or 120*a* separate from panels 116 and 118 and extend outwardly on opposite sides of the display device in plane of panels 114 and 120 so as to rest on the support surface for the device. This arrangement provides an additional exposed flat areas, viz., the upper facing surfaces of tabs 114*a* and 120*a*, on which to provide information of various kinds. The device can, of course, be made to assume the planar configuration shown in FIG. 9 by a "down periscope" action produced by relative movement of the display and support portions, wherein tongue portion 112*a* is drawn down into the opening provided by slots 124*a* and 124*b* and slit 117*a*.

Of course, the applications and variations discussed above relative to FIGS. 1 to 5 also apply to the embodiment of FIGS. 6 to 9. It will be appreciated that the additional exposed areas provided by laterally extending tabs or wings 114*a* and 120*a* provide additional interest as well as additional information space.

Referring to FIGS. 10 to 14, a further embodiment of the invention is shown. This embodiment and those described hereinafter are similar to the preceding figures but instead of displaying only the information printed on the periscoping display portion of the device (e.g., on the display panel 12) also display a planar element or elements mounted on or otherwise secured to this display portion. There are, of course, many examples of planar elements that could be so displayed including credit cards, telephone calling cards, compact discs, diskettes of various types, promotional items (including other, smaller "pop-up" devices), samples of flat objects or items, flat packages of a sample product such as a sachet, and the like.

Figure 14:
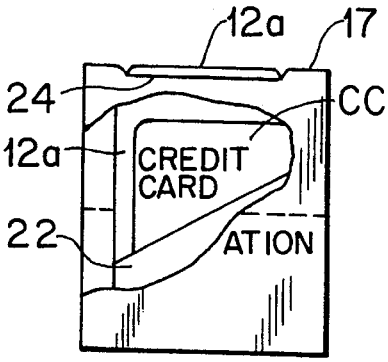
FIG. 14 is a plan view of the assembled device in the planar or collapsed configuration thereof.

The specific implementation illustrated in FIGS. 10 to 14 is similar to that of FIGS. 1 to 5, although it will be appreciated that this embodiment could also be implemented in accordance with the embodiment of FIGS. 6 to 9. In FIGS. 10 to 14, end panel 22 is of the same width as the tongue portion 12*a* of panel 12 and is of a trapezoidal shape including lateral edges 22 and a slanted or inclined distal edge 22*b* which forms an angle with fold line 21. Panel 22 is glued to panel 12 along both the lateral edges 12*a* so as to form a pocket, as best seen in FIG. 14, for receiving a planar element such as the credit card, denoted CC, shown in that figure.

Slot 24 is, of course, made wide enough to accommodate the combined double thickness of panels 12 and 22. In this embodiment, the opening provided by slot 24 includes slits 24*a* at opposite ends thereof which engage the sides of display panel 12. Further, in this embodiment, retaining tabs or webs 12*d* are formed on opposite sides of the tongue member 12*a* between the base of tongue member 12*a* and the shoulders 12*c* of base portion 12*b*, as perhaps can best be seen in FIG. 10. These tabs 12*d* engage in slits 24*a* in the erected configuration of the device shown in solid lines in FIG. 13 so as to retain the device in that configuration.

The operation of the device of FIGS. 10 to 14 is basically the same as that described above, with the credit card CC or other planar element being displayed in the erected configuration and being hidden from view in the planar configuration so that the device acts as a package, container or covering arrangement for the credit card CC or other planar element carried thereby.

Referring to FIG. 15, a further embodiment of the invention is shown which is similar to that of FIGS. 10 to 14 but in which the distal edge 22*b* of end panel 22 is straight across rather than slanted or angled. Again, panels 12 and 22 form a pocket in which, in the illustrated example, a compact disc, denoted CD is received.

Referring to FIG. 16, a blank for yet another embodiment is illustrated. This embodiment is similar to that of FIG. 15 but includes some differences and one additional feature. In this embodiment, end panel 22 is made longer than display panel 12 (compare with FIG. 10) so that the end panel 22 would serve as the backing for the pocket formed by the two panels 12 and 22. Further, slits 24*a* are eliminated and slot 24 includes tapered ends which terminate in points for engagement with engagement tabs 12*d*. In addition, end panel 22 is provided with a tongue portion 22*c* and a base portion 22*d* the latter of which registers or mates with the base portion 12*b* of display panel 12 in the fully assembled device, in a similar manner to the end panel 22 of the embodiment of FIG. 1 to 5. An additional feature concerns the provision of semi-circular embossed lines 26 and 28 on panels 12 and 22, respectively, i.e., lines that have been "bumped up" from the plane of the blank in the shape of the pocket to be formed, by an embossing, stamping or like process, so as to provide a space for receiving a planar element such as the compact disc CD. More generally, in each of the embodiments wherein a pocket or the like is formed, one or more of such embossed lines is preferably provided so as to create a space between panels 12 and 22 for receiving the planar element. This permits the element to be inserted into the "package" formed by the device in the planar configuration of the device by simply dropping or otherwise inserting the element down into the package from the top.

It will, of course, be understood that each of the embodiments of FIGS. 10 to 14, FIG. 15 and FIG. 16 are equally applicable to the "butterfly" configuration of FIGS. 6 to 9. Moreover, the latter configuration can provide additional advantages. For example, an evident advantage is the more interesting appearance provided while a less evident feature is the self-locking action or snap-fit provided by the wings, in the planar configuration, particularly where the device is made of a heavy cardboard or a styrofoam laminate which has a memory and thus will provide a tight fit when compressed. When the device is so constructed the wings, when pressed back into place in the planar configuration, provide a tight fit with the remainder of the device and thus firmly hold the device in this planar or collapsed configuration.

Referring to FIGS. 17 to 19, yet another embodiment of the invention is shown which, in this example, is applied to the basic "butterfly" embodiment or implementation of FIG. 6 to 9 (but is also applicable to the embodiment of FIG. 1 to 5). In this embodiment, the basic display device, denoted 110, is formed and assembled in the same way as that of FIGS. 6 to 9, except that a retaining or holding strap or band 126 is created in tongue portion 112*a* of display panel 112 by two parallel inclined slits 126*a* and 126*b* provided in that panel. Retaining strap or band 126 thus enables a planar element, represented here by a credit card CC, to be retained and displayed in the display configuration and to be stored away out of sight, in the package formed by the device, in the planar configuration of the device.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A display device comprising a support portion and an integral display portion adjoined to said support portion, said display and support portions being relatively movable between a first, planar configuration wherein said display portion is substantially covered by said support portion, and a second, erected configuration wherein said display portion extends upwardly from a base formed by said support portion, said support portion including first and second pairs of serially arranged panels defined by fold lines and formed integrally with said display portion so that, in said planar configuration, said pairs of panels lie flat and overlie respective faces of said display portion and so that in said erected configuration said pairs of panels are disposed at an angle to form said base for said display portion, adjacent panels of said pairs of panels being joined along a central fold line having a central opening therein through which said display portion periscopes during said relative movement of said display and support portions from said planar configuration to said erected configuration, non-adjacent panels of said pairs of panels lying flat on a supporting surface in said erected configuration of the device, and said device including retaining means for retaining the device in the erected configuration upon movement thereof to said erected configuration from said planar configuration.

2. A display device as claimed in claim 1 wherein said display portion comprises a first display panel including a tongue portion and a base portion including shoulders disposed on opposite sides of said tongue portion.

3. A display device as claimed in claim 2, wherein said display portion further includes an end panel joined to one panel of said pairs of panels along a further fold line and secured to said display panel.

4. A display device as claimed in claim 3 wherein said end panel is secured to the base portion of said display panel.

5. A display device as claimed in claim 2 wherein said opening comprises a slot and said retaining means includes slits of narrower width than said slot formed at opposite ends of said slot.

6. A display device as claimed in claim 5 wherein said retaining means includes lateral portions of said display portion which engage in said slits.

7. A display device as claimed in claim 6 wherein said lateral portions comprise oppositely extending, laterally projecting web portions formed between the tongue portion and base portion of said display panel.

8. A display device as claimed in claim 1 wherein said retaining means includes a portion of said opening.

9. A display device as claimed in claim 8 wherein said opening comprises a slot and said retaining means includes slits of narrower width than said slot formed at opposite ends of said slot.

10. A display device as claimed in claim 9 wherein said retaining means includes lateral portions of said display portion which engage in said slits.

11. A display device as claimed in claim 1 wherein said display portion includes mounting means for mounting a planar element thereon, said mounting means including a pair of spaced slits formed in said display portion and creating a retaining band in which the planar element is received.

12. A display device as claimed in claim 11 wherein said slits are parallel to each other and form an angle with respect to said central fold line.

13. A display device as claimed in claim 1 wherein said display portion includes a display panel and an end panel joined to one panel of said pair of panels of said support portion along a further fold line, said end panel being secured to said display panel, and said display panel and end panel together forming mounting means for mounting a planar element on said display portion.

14. A display device as claimed in claim 13 wherein said mounting means comprises a pocket formed between said display and end panels.

15. A display portion as claimed in claimed 14 wherein said end panel is shorter in length than said display panel and terminates in a free edge, said display and end panels being secured together such that an aperture is created at said free edge of said end panel so as to define an opening for said pocket for receiving the planar element.

16. A display device as claimed in claim 15 wherein said free edge forms an angle with respect to said further fold line.

17. A display device as claimed in claim 15 wherein said free edge extends parallel to said further fold line.

18. A display device comprising a support portion and an integral display portion adjoined to said support portion, said display and support portions being relatively movable between a first, planar configuration wherein said display portion is substantially covered by said support portion, and a second, erected configuration wherein said display portion extends upwardly from a base formed by said support portion, said support portion including first and second pairs of serially arranged panels defined by fold lines and formed integrally with said display portion so that, in said planar configuration, said pairs of panels lie flat and overlie respective faces of said display portion and so that in said erected configuration said pairs of panels are disposed at an angle to form said base for said display portion, adjacent panels of said pairs of panels being joined along a central fold line having a central opening therein through which said display portion periscopes during said relative movement of said display and support portions from said planar configuration to said erected configuration, non-adjacent panels of said pairs of panels lying flat on a supporting surface in said erected configuration at the device, and said display portion including a display panel joined to one panel of said pair of panels of said support portion along a fold line and an end panel joined to a further panel of said pair of panels of said support portion along a further fold line, said end panel being secured to said display panel, and said end panel and said display panel together forming a pocket for mounting a planar element on said display portion.

19. A display device as claimed in claim 18 wherein said display portion comprises a first display panel including a tongue portion and a base portion including shoulders disposed on opposite sides of said tongue portion.

20. A display device as claimed in claim 18, wherein said display portion further includes an end panel joined to one panel of said pairs of panels along a further fold line and secured to said display panel.

21. A display device as claimed in claim 18 wherein said end panel is shorter in length than said display panel and terminates in a free edge, said display and end panels being secured together such that an aperture is created at said free edge of said end panel so as to define an opening for said pocket for receiving the planar element.

22. A display device as claimed in claim 18 further comprising retaining means associated with said opening for retaining said device in said erected configuration upon movement thereof to said erected configuration from said planar configuration.

23. A display device as claimed in claim 18 wherein said at least one panel of said support portion includes a wing portion projecting laterally of said device in said erected configuration of said device.

24. A display device comprising a support portion and an integral display portion adjoined to said support portion in such a manner that the portions are relatively movable between a first, planar configuration of the device wherein at least a part of said display portion is covered by said support portion, and a second, erected configuration of the device wherein said display portion extends upwardly from a flat base formed by said support portion, said display portion comprising a display panel including a tongue portion adapted to be displayed in the erected configuration of the device and a base portion including shoulders disposed on opposite sides of said tongue portion, said support portion comprising first and second pairs of serially arranged panels which, in said planar configuration, are disposed so as to lie flat and to overlie respective faces of said display panel and which, in said erected configuration, are arranged at an angle to form said flat base for said display panel, the panels of said pairs of panels being respectively joined along first and second fold lines, one panel of one of said pairs of panels being joined to said display panel along a third fold line, and adjacent panels of said pairs of panels being joined together along a fourth fold line, said support portion including an opening formed along said fourth fold line centrally thereof through which said tongue portion of said display panel periscopes during said relative movement of said display and support portions from said first configuration to said second configuration, said support portion further including an end panel joined to one panel of the other of said pairs of panels along a fifth fold line and secured to said base portion of said display panel in registration with a part of said base portion, said end panel and said part of said base portion being of the same axial width and said shoulders of said base portion limiting the periscoping movement of said display panel, said one panel of said one pair of panels and said one panel of said other pair of panels forming said flat base in said erected configuration, and said opening cooperating with said tongue portion to retain the device in said erected configuration.

25. A display device comprising a support portion and an integral display portion adjoined to said support portion, said display and support portions being relatively movable between a first, planar configuration wherein said display portion is covered by said support portion, and a second, erected configuration wherein said display portion extends upwardly from a base formed by said support portion, said support portion including first and second pairs of serially arranged panels having straight, parallel side edges, said serially arranged panels being defined by fold lines and being formed integrally with said display portion so that in said planar configuration said pairs of panels lie flat and overlie respective faces of said display portion and so that in said erected configuration said pairs of panels are disposed at an angle to form said base for said display portion, adjacent panels of said pairs of panels being joined along a central fold line having a central opening therein through which said display portion periscopes during said relative movement of said display and support portions from said planar configuration to said erected configuration, non-adjacent panels of said pairs of panels lying flat on a supporting surface in said erected configuration of the device, and said display portion including a display panel comprising a tongue portion which extends at least partially through said central opening in said erected configuration of the device and a base portion extending laterally outwardly from said display portion on opposite sides thereof, said base portion being joined to, and extending outwardly to the side edge of, one of said non-adjacent panels of said pairs of panels, said display portion further including an end panel joined to the other non-adjacent panel of said pairs of panels by a further fold line and secured to said display panel, said end panel being of the same size and shape as said base portion of display panel and being directly secured thereto by an adhesive.

* * * * *